US008997485B2

(12) United States Patent
Sumser et al.

(10) Patent No.: US 8,997,485 B2
(45) Date of Patent: Apr. 7, 2015

(54) TURBINE FOR AND EXHAUST GAS TURBOCHARGER

(71) Applicant: Daimler AG, Stuttgart (DE)

(72) Inventors: Siegfried Sumser, Stuttgart (DE); Torsten Hirth, Rutesheim (DE)

(73) Assignee: Daimler AG, Stuttgart (DE)

( * ) Notice: Subject to any disclaimer, the term of this patent is extended or adjusted under 35 U.S.C. 154(b) by 100 days.

(21) Appl. No.: 13/684,543

(22) Filed: Nov. 25, 2012

(65) Prior Publication Data

US 2013/0104539 A1 May 2, 2013

Related U.S. Application Data

(63) Continuation of application No. PCT/EP2011/002018, filed on Apr. 20, 2011.

(30) Foreign Application Priority Data

May 28, 2010 (DE) ..... 10 2010 021 928

(51) Int. Cl.

| | |
|---|---|
| ***F02D 23/00*** | (2006.01) |
| ***F01D 17/12*** | (2006.01) |
| ***F01D 17/14*** | (2006.01) |
| ***F01D 9/02*** | (2006.01) |
| ***F01D 25/26*** | (2006.01) |

(52) U.S. Cl.

CPC ..... *F01D 17/143* (2013.01); *F01D 9/026* (2013.01); *F01D 25/26* (2013.01); *F05D 2220/40* (2013.01)

(58) Field of Classification Search

CPC ..... F01D 9/026; F01D 25/26; F01D 17/143; F01D 17/14; F01D 17/141; F01D 17/165; F01D 17/167; F05D 2220/40; F02B 37/025; F02B 37/22; F02M 25/0707; Y02T 10/144

USPC ..... 60/602, 605.2; 415/192, 205, 151, 202, 415/206, 163–166

See application file for complete search history.

(56) References Cited

U.S. PATENT DOCUMENTS

| | | | | |
|---|---|---|---|---|
| 3,137,477 | A * | 6/1964 | Kofink | 415/166 |
| 3,358,439 | A * | 12/1967 | De Coye De Castelet | 60/605.1 |
| 4,008,010 | A * | 2/1977 | Fauconnet | 417/405 |
| 4,177,005 | A * | 12/1979 | Bozung et al. | 415/128 |
| 4,565,068 | A * | 1/1986 | Schneider | 60/602 |
| 7,047,739 | B2 * | 5/2006 | Fledersbacher et al. | 60/602 |
| 2006/0230759 | A1 * | 10/2006 | Semrau | 60/602 |
| 2007/0209361 | A1 | 9/2007 | Pedersen | |
| 2008/0209905 | A1 * | 9/2008 | Petitjean et al. | 60/602 |

(Continued)

FOREIGN PATENT DOCUMENTS

| | | | |
|---|---|---|---|
| DE | 10 2008 039 085 A1 | 2/2010 | |
| JP | 59203823 A * | 11/1984 | F02B 39/00 |

*Primary Examiner* — Thai Ba Trieu
*Assistant Examiner* — Jason T Newton
(74) *Attorney, Agent, or Firm* — Klaus J. Bach

(57) ABSTRACT

In a turbine for an exhaust gas turbocharger of an internal combustion engine comprising a turbine housing part, which has at least two spiral channels with respective inlets through which exhaust gas of the internal combustion engine is directed onto a turbine rotor disposed in the turbine housing part, the turbine housing part is disposed in an accommodating chamber, which is formed by a further housing part of the turbine, and from which accommodating chamber exhaust gas of the internal combustion engine can flow through the channel inlets into the spiral channels.

9 Claims, 2 Drawing Sheets

(56) References Cited

U.S. PATENT DOCUMENTS

2009/0047121 A1* 2/2009 Whiting et al. ..... 415/144
2009/0060716 A1* 3/2009 Ante et al. ..... 415/118
2010/0196145 A1* 8/2010 Lombard et al. ..... 415/148
2010/0232955 A1* 9/2010 Schick et al. ..... 415/204
2013/0047606 A1* 2/2013 Kuhn et al. ..... 60/605.1

* cited by examiner

54

TURBINE FOR AND EXHAUST GAS TURBOCHARGER

This is a Continuation-In-Part application of pending international patent application PCT/EP2011/002018 filed Apr. 24, 2011 and claiming the priority of German patent application 10 2010 021 928.2 filed May 28, 2010.

BACKGROUND OF THE INVENTION

The invention relates to a turbine for an exhaust gas turbocharger of an internal combustion engine comprising a housing with at least two spiral inlet channels directing engine exhaust gas onto a turbine rotor.

DE 10 2008 039 085 A1 discloses an internal combustion engine for a motor vehicle with an exhaust gas turbocharger comprising a compressor in an intake tract of the internal-combustion engine and a turbine in an exhaust gas tract of the internal-combustion engine, wherein the turbine has a turbine housing, which has a spiral channel coupled with an exhaust gas pipe of the exhaust gas tract and a turbine wheel, which is arranged inside an accommodating chamber of the turbine housing. For driving the compressor wheel of the compressor which compressor wheel is connected by a shaft to the turbine wheel for rotation therewith the exhaust gas of the internal-combustion engine is conducted through the spiral channel onto the turbine wheel. The turbine comprises an adjustment device, by means of which a spiral inlet cross-section of the spiral channel as well as a nozzle cross-section of the spiral inlet channel common to the accommodating chamber can be adjusted.

Since such an exhaust gas turbocharger is a mass-produced device which is needed in constantly growing quantities, it is desirable to provide an exhaust gas turbocharger which is efficient, that is to say provides for low consumption and low-emission operation of the corresponding internal-combustion engine as well as for a high reliability in operation under maximum temperature- and pressure changes.

It is therefore the object of the present invention to provide a turbine for an exhaust gas turbocharger, which as well as having high reliability in operation, permits efficient operation of an internal combustion engine associated with the exhaust gas turbo-charger.

SUMMARY OF THE INVENTION

In a turbine for an exhaust gas turbocharger of an internal combustion engine comprising a turbine housing part, which has at least two spiral channels with respective inlets through which exhaust gas of the internal combustion engine is directed onto a turbine rotor disposed in the turbine housing part, the turbine housing part is disposed in an accommodating chamber, which is formed by a further housing part of the turbine, and from which exhaust gas of the internal combustion engine can flow through the channel inlets into the spiral channels.

As a result of the constant tightening of emission limit values, in particular nitrogen oxide and soot emissions, exhaust gas turbochargers are becoming very important for supercharging an internal combustion engine. The tightening of the emission values results in high demands regarding supercharging by exhaust gas turbo-chargers for achieving high AGR (exhaust gas recycling) rates in the medium to full load ranges of the internal combustion engine. This requires the realisation of a turbine, which is geometrically small in respect to its dimensions or volume, for such an exhaust gas turbocharger, the high turbine performances demanded being achieved by increasing the ram-induction capacity or by decreasing the absorption capacity of the turbine interacting with the internal combustion engine.

Furthermore an inlet pressure level of the turbine is possibly increased by the back pressure of an emission control device, in particular a soot filter, arranged in the flow direction of the exhaust gas downstream to the turbine, which requires a further reduction of the turbine in respect to its dimension or volume. This is accompanied by the problem that such a reduction of the turbine size is usually associated with a degradation in the efficiency of the turbine. However, in order to satisfy a power demand at the compressor side of the exhaust gas turbocharger, it is necessary to achieve a desired fresh air-exhaust gas delivery and thus to obtain a desired torque or desired performance of the turbine as well as low emissions of the internal combustion engine.

The inventive turbine can be small in respect to its dimensions or volume but still realize desired ram-induction behavior. This permits high exhaust gas recirculation rates. In other words, a particularly large quantity of exhaust gas can be recycled from an exhaust gas side of the internal combustion engine to an air intake side of the same and mixed with air drawn in by the internal combustion engine, as a result of which the emissions, in particular nitrogen oxide- and soot emissions, of the internal combustion engine can be reduced.

In addition the described, high power demand on the compressor side of the exhaust gas turbocharger can be satisfied by the turbine, since it enables the internal combustion engine associated therewith to be operated in ram-induction mode. In this case the accommodating chamber formed as collecting space by the further housing part, in which the exhaust gas of the internal combustion engine is first collected and accumulated before it flows through the spiral channels and drives the turbine, can drive a compressor wheel on the compressor side of the exhaust gas turbocharger. Furthermore the turbine has a minimum number of parts, which is accompanied by low cost as well as high reliability in the operation of the turbine.

In an advantageous embodiment of the invention the spiral channels in each case have at least one nozzle cross-section, via which the exhaust gas is directed onto the turbine wheel mounted in the first housing part, the nozzle cross-sections being arranged around the turbine wheel next to each other and/or distributed over the periphery of the turbine wheel. Thus the turbine can be adapted to various demands in order to meet the requirements regarding the realization of a desired fresh air- or fresh air-exhaust gas supply as well as low emissions of the internal combustion engine.

If the turbine includes an adjustment device, by means of which the respective spiral inlet cross-sections and/or the respective nozzle cross-sections of the spiral channels can be adjusted, it is possible for example to simultaneously adjust the spiral inlet cross-section and the nozzle cross-section of one of the spiral channels by means of the adjustment device. Simultaneously, spiral inlet cross-section and the nozzle cross-section of the other spiral channels may be adjusted by means of the adjustment device. The turbine can further be adapted to various operating points at least almost over the total performance range of the internal combustion engine that is both within the low and medium load ranges and in the full load range. The adjustment device in particular also enables the ram-induction behavior of the turbine to be adjusted. As a result, a fresh air and exhaust gas recycling requirement can be influenced over a particularly broad spectrum to meet consumption and emission demands.

This is advantageous in the context of an application for a commercial motor vehicle. The turbine however is also particularly advantageous for an application in a passenger car, wherein the internal combustion engine load changes frequently. Due to the variable ram-induction capacity of the turbine, acceptable driving performance is achievable despite the load changes of the internal combustion engine during operation of the passenger car, and also with internal combustion engines, which have only small engines with low cylinder volumes and high specific performance in accordance with the downsizing concept.

In this case the adjustment device comprises for example at least one blocking body for each spiral channel, by means of which the spiral inlet cross-section and/or the nozzle cross-section can be adjusted, the blocking body being formed in the shape of an axial slide. The turbine is therefore designed as so-called axial slide segment turbine, which has a minimum number of parts as well as the combination of flow-relevant spiral channels with an economical and robust turbine housing concept. To achieve high operational exhaust gas flow variations, the first housing has more than the described two spiral channels and therefore more than two spiral segments.

The spiral channels, which are called multi-segment spirals, are part of the first housing part. They are manufactured separately from the second housing part for example by a precise production process and are then connected to the second housing part, which acts as collecting housing that surrounds the multi-segment spirals and is sealed in a gas-tight manner against the environment. The second housing part, whose accommodating chamber is circular but may for example also formed in a spiral shape, directs the exhaust gas of the internal combustion engine to the inlets of the spiral channels in a manner gas-tight against the environment. It also has a function of supporting the turbine or the complete exhaust gas turbocharger. In addition it has a function of providing protection from a turbine rotor bursting, which includes the turbine wheel, the shaft, the compressor wheel of the compressor of the exhaust gas turbocharger as well as possibly further components.

The first housing part forming the spiral channels and/or the blocking body or bodies of the adjustment device is or are for example produced by a casting process, in particular an investment casting process, and/or formed as plates with advantageously very smooth flow surfaces, which permits very precise adjustment of the spiral channels as well as possibly of the blocking bodies.

The second housing part surrounding the first housing part possibly has relatively simple geometry, so that it can be produced economically by a relatively rough standard sand casting process. This keeps the costs of the inventive turbine to a minimum. The two housing parts are connected for example by means of an economical mounting, joining and/or a sealing process, where it is equally possible that the first housing part is molded into the second housing part.

Combination of the second housing part comprising the accommodating chamber with the first housing part comprising the spiral channels, rendered possible by the inventive turbine, leads to the fact that with the one second housing part and several second housing parts differing from each other as modules, which for example have two, three, four, five, six, seven or more spiral channels in conjunction with adapted adjustment devices, an advantageous component system is created to provide for a diverse turbine behavior. This component system then ensures the availability of an adapted thermodynamic behavior of the turbine in a broad range of application of internal combustion engines, which can be operated with efficient combinations and production series simplifications of the turbine. In other words for different variants of the turbine, the variants having the number of spiral channels differing from one another, the second housing part can be used as a generic part which therefore keeps the costs of the component system to a minimum.

The invention will become more readily apparent from the following description of exemplary embodiments thereof with reference to the accompanying drawings. The features and feature combinations mentioned in the description above as well as the features and feature combinations mentioned below in the figure description and/or only shown in the figures may be used not only in the combination indicated in each case, but also in other combinations or alone without leaving the framework of the invention.

DESCRIPTION OF A PARTICULAR EMBODIMENT

Figure 1:
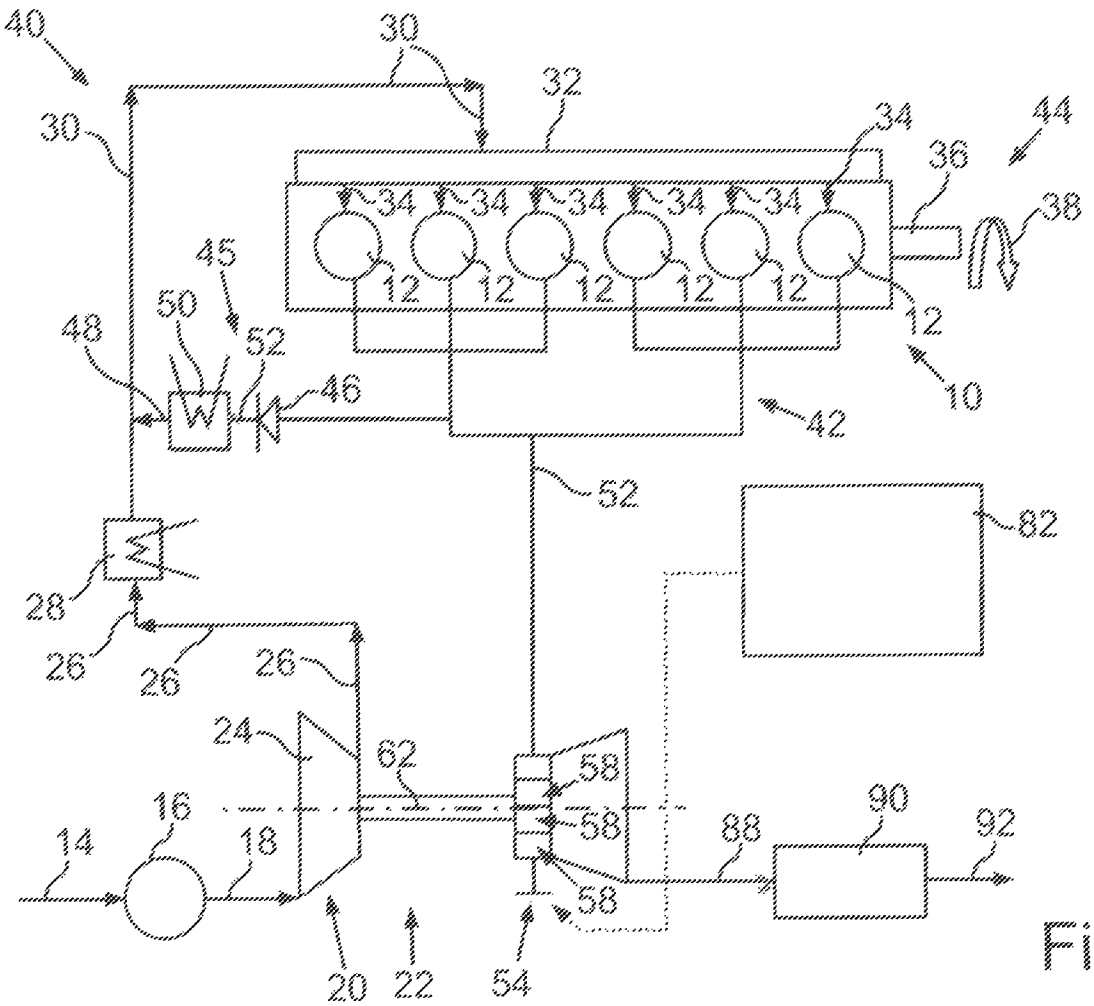
FIG. 1 shows a general arrangement of an internal combustion engine, which is supercharged by means of an exhaust gas turbocharger, which comprises an axial slide multi-segment turbine, which enables the internal combustion engine to operate in ram-induction mode.

FIG. 1 illustrates an internal combustion engine 10 with six cylinders 12. During operation of the internal combustion engine 10 air is drawn into the engine as indicated by a directional arrow 14. The air is filtered by means of an air filter 16 and, as indicated by a directional arrow 18, flows further into a compressor 20 of an exhaust gas turbocharger 22 associated with the internal combustion engine 10. In this case, fresh air is compressed by the compressor 20 by means of a compressor wheel 24, as a result of which air is heated. For cooling the air compressed and heated in this way, the air then flows as indicated by the directional arrows 26 to an intercooler 28 and further as per directional arrows 30, to an air intake manifold 32 via which it is fed as per directional arrows 34 to the cylinders 12. In the cylinders 12 the drawn-in and compressed air is mixed with fuel which is combusted, as a result of which a crankshaft 36 of the internal combustion engine 10 rotates as per a directional arrow 38.

The compressor 20 arranged on an air side 40 of the internal combustion engine 10 serves to provide a desired fresh air supply of the internal combustion engine 10 to achieve a desired performance- or torque level of the internal combustion engine 10. Thus the internal combustion engine 10 can be designed small with respect to its displacement capacity and thus in respect to its dimensions, which results in light-weight is accompanied by high specific performance, minimum fuel consumption, and therefore low $CO_2$ emissions.

Exhaust gas of the internal combustion engine 10 resulting from the combustion in the cylinders 12 is conducted by means of exhaust gas piping 42 at an exhaust gas side 44 of the internal combustion engine initially to an exhaust gas recycling device 45, by means of which exhaust gas of the internal combustion engine 10 is recycled from the exhaust gas side 44 to the air intake side 40. The exhaust gas recycling device 45 also comprises an exhaust gas recycling valve 46, by means of which a specific quantity of exhaust gas to be recycled, coordinated with a current operating point of the internal combustion engine 10, can be adjusted. The exhaust gas flows as per a directional arrow 52 to an exhaust gas recycling cooler 50, by which the exhaust gas is cooled, before it is conducted as per a directional arrow 48 to the fresh air drawn in by the internal combustion engine 10. This mixing of drawn in air with the recycled exhaust gas leads to a reduction of emissions, in particular nitrogen oxide- and particulate emissions, of the internal combustion engine 10, as a result of which the engine has not only has low fuel consumption and high performance but also low emissions.

Figure 2:
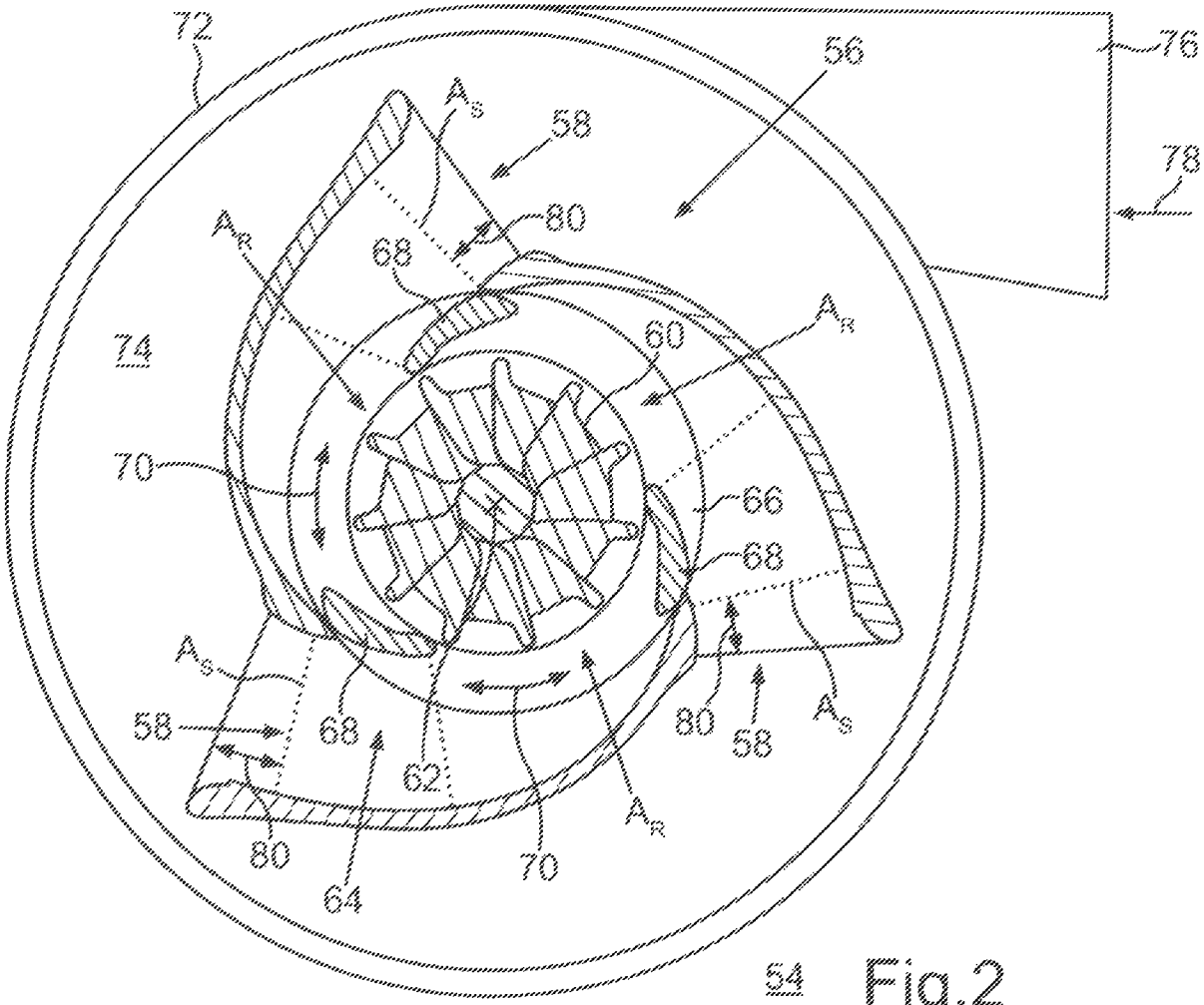
FIG. 2 is a schematic cross-sectional view of the axial slide multi-segment turbine in accordance with FIG. 1.

Furthermore the exhaust gas is conducted by means of the exhaust gas piping 42 to a turbine 54 of the exhaust gas turbocharger 22, the turbine 54 being designed as single-flow so-called axial slide multi-segment turbine, which is described in connection with FIG. 2. The turbine 54 comprises a first housing part 56, which has three spiral channels 58, through which exhaust gas of the internal combustion engine 10 can flow. The spiral channels 58 have respective spiral inlet cross-sections $A_S$ as well as respective nozzle cross-sections $A_R$. A turbine wheel 60 of the turbine 54 is rotatably mounted in the housing part 56.

The exhaust gas of the internal combustion engine 10 now enters the spiral channels 58 via the respective spiral inlet cross-sections $A_S$ and flows onto the turbine wheel 60 via the respective nozzle cross-sections $A_R$, as a result of which the turbine wheel 60 is driven by the exhaust gas and rotates. The turbine wheel 60 is connected to a shaft 62 of the exhaust gas turbocharger 22, to which also the compressor wheel 24 is connected, as a result of which the compressor wheel 24 is driven via the shaft 62 by the turbine wheel 60. The shaft 62 has a rotational axis 63.

The turbine 54 also comprises an adjustment device 64, which in turn comprises an adjusting ring 66, which is connected to three blocking bodies in the form of axial slides 68, of which one axial slide 68 is each associated with a spiral channel 58. The adjusting ring 66 can be rotated as per directional arrows 70 about the rotational axis 63 of the turbine wheel 60, as a result of which the spiral inlet cross-sections $A_S$ as well as the nozzle cross-sections $A_R$, arranged in the circumferential direction of the turbine wheel 60 symmetrically distributed over its periphery, can be adjusted. In other words this means that the axial slides 68 can be adjusted between at least one position constricting or even closing the nozzle cross-sections $A_R$ and at least one position releasing the one opposite the nozzle cross-sections $A_R$ by turning the adjusting ring 66. Through the adjustment device 64 a variability of the turbine 54 is created, as a result of which the turbine 54 can be adapted to various operating points at least almost over the total performance graph of the internal combustion engine 10, in order to achieve efficient and thus lean fuel consumption as well as low-emission operation of the internal combustion engine 10. As a result of adjusting the nozzle cross-sections $A_R$ the ram-induction behavior or the throughput behavior of the turbine 54 can be variably adjusted.

As a result of the spiral channels 58, by which several segments of the turbine 54 are formed, in the first instance a pulse-charging operation of the internal combustion engine 10 is possible. To enable the internal combustion engine 10 to operate in ram-induction mode, the turbine 54 now comprises a further housing part 72 of circular cross-section which extends around the first housing part in radially spaced relationship so as to form an accommodating chamber 74, in which the first housing part 56 is accommodated, sealed in a gas-tight manner against the environment by the further housing part 72 also with respect to the spiral channels 58. The further housing part 72 surrounds the first housing part 56 on the side of a bearing device and therefore on a side facing the compressor wheel 24 and/or on a side facing this side, thus on the side of a turbine outlet. The further housing part 72 has a tangential inflow channel 76, into which exhaust gas can flow via the exhaust gas piping 42 as per a directional arrow 78 and which guides the exhaust gas further into the accommodating chamber 74. As evident from FIG. 2, the inflow channel 76 tapers in the flow direction of the exhaust gas as per the directional arrow 78. The exhaust gas conducted via the inlet channel 76 into the accommodating chamber 74 is initially collected in the accommodating chamber 74 and flows through the spiral channels 58 to the turbine wheel 60. The exhaust gas therefore is mixed and also collected in the flow direction of the exhaust by the exhaust gas piping 42 upstream of the turbine 54.

Upstream of the respective spiral inlet cross-sections $A_S$, the spiral channels 58 each have an at least substantially trumpet-shaped inlet area 80, through which the exhaust gas can enter the spiral channels 58. The turbine 54 has high variability, as a result of which varying ram-induction behavior and thus different recirculation rates can be achieved. Likewise this enables a certain fresh air supply of the internal combustion engine 10 to materialize in order to meet high performance- or torque requirements. Furthermore the turbine 54 has only a minimum number of parts, which is accompanied by low costs and high reliability in operation.

In principle it is also possible to create double-flow turbines similar to the arrangement of the turbine 54, wherein along the rotational axis 62 of the turbine wheel 60, apart from the first housing part 56, an additional housing part with at least two spiral channels, for example in the form of the first housing part 56, is then arranged, that is accommodated in an additional accommodating chamber in accordance with the accommodating chamber 74, formed by the additional housing part in accordance with the further housing part 72 of circular cross-section. Thus the accommodating chambers are then arranged in parallel and separated in a gas-tight manner from each other. In this case two housing parts 56 connected in parallel are provided, which each have a certain ram-inducing effect as well as a certain pulse-charging of the two collecting spaces sealed in a gas-tight manner to each other, with cylinders groups of the cylinders 12 of the internal combustion engine 10 being separated, for example by means of an elbow. As a result, with an adjustment device on both sides in accordance with the adjustment device 64 and corresponding axial slides 68, a variable quasi double-flow impulse turbine is created, which can also incorporate the asymmetric ram-induction behavior, depending in each case on the intended purpose.

The adjustment device 64 of the turbine 54 in this case is controlled or regulated by a control device 82 of the internal combustion engine 10 which adjusts the adjustment device 64, in order to adapt the turbine 54 to a current operating point of the internal combustion engine 10.

After impinging on, and driving, the turbine wheel 60 the exhaust gas flows out of the turbine 54 via the turbine outlet as per a directional arrow 88 and flows through an after-treatment exhaust gas device 90, which for example comprises a catalyst, particularly a nitrogen oxide catalyst, as well as possibly a particulate filter, after which the exhaust gas flows out as per a directional arrow 92 purified to the environment.

What is claimed is:

1. A turbine of an exhaust gas turbocharger (22) of an internal combustion engine (10), comprising at least a first inner housing part (56), which has at least two spiral inlet channels (58) with trumpet-shaped inlet areas (80) which are arranged circumferentially spaced around the first housing part (56), the first housing part (56) with the at least two spiral inlet channels (58) being disposed in a second, outer housing part (72) extending annularly all around the first housing part (56) in spaced relationship therefrom and forming a sealed accommodating chamber (74) in communication with the internal combustion engine to receive and direct an exhaust gas flow of the internal combustion engine (10) through the at least two spiral inlet channels (58) to a turbine wheel (60) disposed within the first housing part (56).

2. The turbine according to claim 1, wherein each of the at least two spiral inlet channels (58) has a nozzle cross-section (AR), via which the turbine wheel (60) of the turbine (54) mounted in the first housing part (56) is impinged by the exhaust gas, wherein the nozzle cross-sections (AR) are arranged along a rotational axis (62) of the turbine (60) and an adjustment device (64) is arranged around the turbine wheel (60) to adjust the respective nozzle cross-section (AR) of each of the at least two spiral inlet channels (58).

3. The turbine according to claim 1, wherein the at least two spiral inlet channels (58) are formed with a wrap-round angle of together at least 350°.

4. The turbine according to claim 1, wherein each of the at least two spiral inlet channels has a wraparound angle of at least 30°.

5. The turbine according to claim 1, wherein the first housing part (56) comprising the at least two spiral channels (58) is one of an investment casting and a stamped sheet metal part.

6. The turbine according to claim 1, wherein the second outer housing part (72) defining the accommodating chamber (74) is a cast part.

7. The turbine according to claim 1, wherein the first housing part (56) is molded into the second outer housing part (72).

8. The turbine according to claim 1, wherein a tangential inflow channel (76) to the second outer housing part (72) has a flow cross-section which is tapered according to a direction of the exhaust gas flow.

9. The turbine according to claim 1, wherein the second outer housing part (72) defining the accommodating chamber (74) has a circular cross-section and the tangential inflow channel extends tangentially with respect to the circular second housing part (72).

* * * * *